US006487997B2

(12) United States Patent
Palumbo

(10) Patent No.: US 6,487,997 B2
(45) Date of Patent: Dec. 3, 2002

(54) SPRINGLESS POPPET VALVE SYSTEM

(76) Inventor: Chris Palumbo, 1436 W. River Park, Inkster, MI (US) 48141

( * ) Notice: Subject to any disclaimer, the term of this patent is extended or adjusted under 35 U.S.C. 154(b) by 0 days.

(21) Appl. No.: 09/825,109

(22) Filed: Apr. 3, 2001

(65) Prior Publication Data

US 2002/0139335 A1 Oct. 3, 2002

(51) Int. Cl.[7] ..... F01L 1/30

(52) U.S. Cl. ..... 123/90.24; 123/90.25; 123/90.26; 123/90.39

(58) Field of Search ..... 123/90.24, 90.25, 123/90.26, 90.39, 90.43, 90.44, 90.45, 90.46, 90.67, 188.13; 251/251

(56) References Cited

U.S. PATENT DOCUMENTS 1,544,784 A * 7/1925 Thomas ..... 123/90.24
2,857,896 A 10/1958 Schnepel
2,937,633 A 5/1960 Lorenz
4,020,629 A 5/1977 Wilmot et al.
4,308,828 A * 1/1982 Kinsel ..... 123/90.39
4,754,728 A 7/1988 Bordi et al.
4,928,650 A 5/1990 Matayoshi et al.
4,944,256 A 7/1990 Matayoshi et al.
5,048,474 A 9/1991 Matayoshi et al.
5,732,670 A 3/1998 Mote, Sr.

* cited by examiner

*Primary Examiner*—John J. Vrablik
*Assistant Examiner*—Jaime Corrigan
(74) *Attorney, Agent, or Firm*—Leydig, Voit & Mayer, Ltd.

(57) ABSTRACT

A springless poppet valve system is provided. The system includes a poppet valve movable between an open position and a closed position. The system includes an open cam and a close cam. An open rocker arm is provided which engages the open cam. The open rocker arm is operatively connected to the poppet valve so as to move the valve from the closed position to the open position. A close rocker arm is provided which engages the close cam. The close rocker arm is operatively connected to the poppet valve so as to move the valve from the open position to the close position. An open hydraulic lifter is pivotally connected to the open rocker arm. A close hydraulic lifter is pivotally connected to the close rocker arm.

9 Claims, 3 Drawing Sheets

SPRINGLESS POPPET VALVE SYSTEM

FIELD OF THE INVENTION

The present invention relates generally to the valve train of an internal combustion engine and, more particularly, to a springless poppet valve system.

BACKGROUND OF THE INVENTION

Conventional poppet valve systems used in four-stroke internal combustion engines are typically biased to a closed position using a spring. The valve is moved to an open position against the force of the spring by a cam or cam-actuated rocker arm. On the open stroke of the valve, the cam or rocker arm also must move the valve counter to the momentum of the valve such that the open force required is effectively doubled. These conventional poppet valve systems, however, are limited with regard to speed at which the valves can be actuated. As will be appreciated, the limit on the valve actuation speed, in turn, limits the rate at which the engine can turn (i.e., engine rpm). As engine torque and speed dictate engine power, limits on the engine rpm constrain the power of an engine.

In particular, increasing the actuation speed of the valve necessarily increases the force and stress applied to the components of the valve train. To compensate for the increased force and stress, the valve train components must be made stronger. Strengthening the valve train components is most often achieved by increasing the mass of the components. This increased mass, however, requires the use of a stiffer valve spring which, in turn, further increases the force and stress on the valve train components. Moreover, increasing the mass of the valve train components increases the overall weight of the engine and, therefore, has a detrimental effect on engine performance. Thus, a balance between the stiffness of the valve spring and the mass of the. valve train components limits the peak valve actuation speed of a valve train.

Removing the spring from the valve train alleviates the issues regarding the force need to open the valve, however, such springless valve systems are expensive to manufacture and maintain. Specifically, current springless valve systems must be manufactured and assembled to very tight tolerances in order to prevent lash or binding in the system. Additionally, during operation, because of the tight tolerances that are required, springless poppet valve systems frequently have to be adjusted resulting increased maintenance requirements.

OBJECTS AND SUMMARY OF THE INVENTION

Accordingly, in view of the foregoing, a general object of the present invention is to provide a poppet valve system for an internal combustion engine which overcomes the problems associated with existing poppet valve systems.

A more specific object of the present invention is to provide a poppet valve system as characterized above which can achieve higher valve actuation speeds than existing springless poppet valve systems.

Another object of the present invention is to provide a poppet valve system as characterized above which is less costly to manufacture and assemble than existing springless poppet valve systems.

A further object of the present invention is to provide a poppet valve system as characterized above which requires less maintenance than existing poppet valve systems.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF A PREFERRED EMBODIMENT

Figure 1:
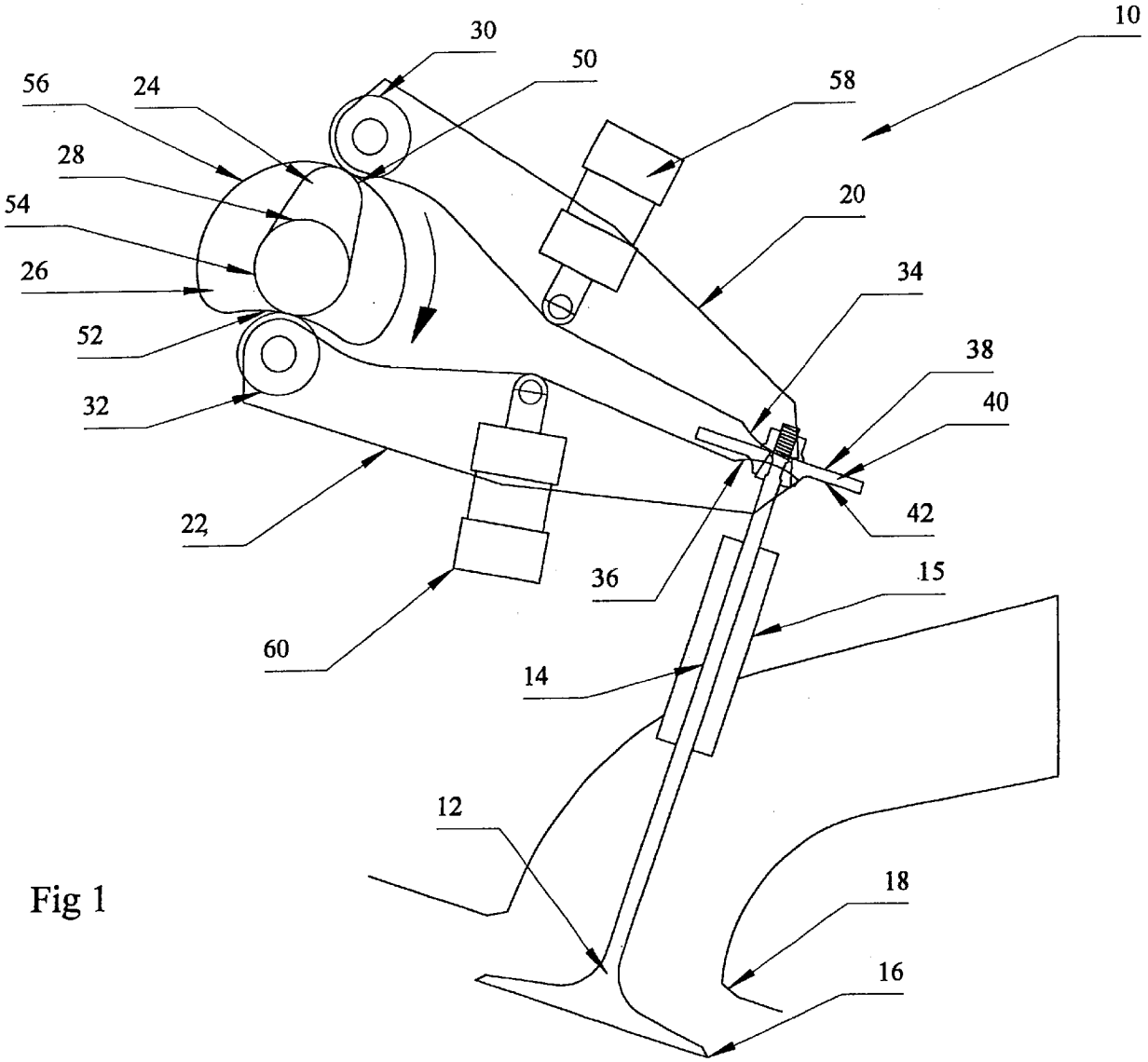
FIG. 1 is a side elevation view of an illustrative poppet valve system constructed in accordance with the teachings of the present invention with the valve in the open position.
Figure 2:
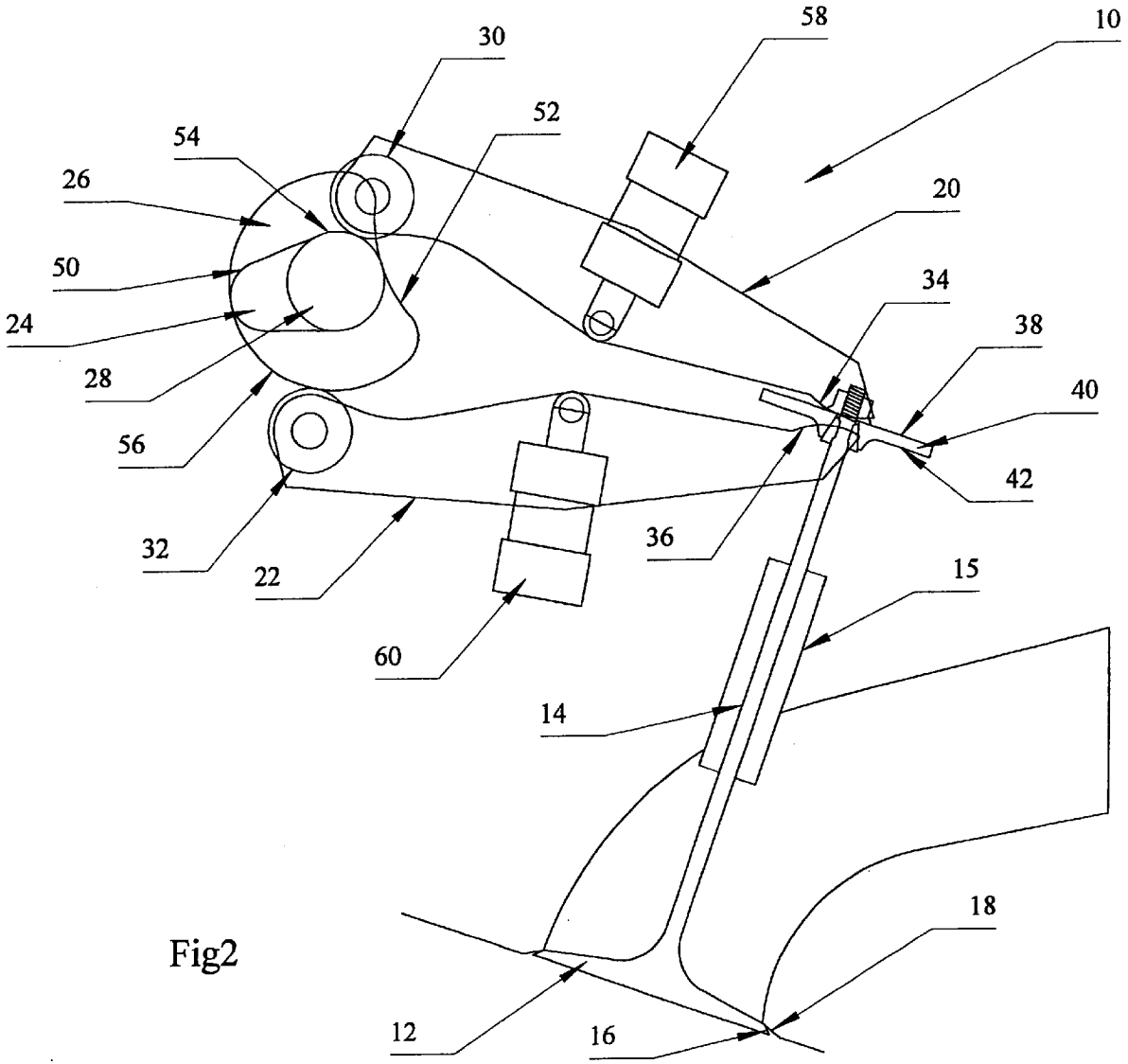
FIG. 2 is a side elevation view of the poppet valve system of FIG. 1 with the valve in the closed position.

Referring now more particularly to FIGS. 1 and 2 of the drawings, there is shown an illustrative embodiment of a poppet valve system 10 for an internal combustion engine constructed in accordance with the present invention. The illustrated poppet valve 12, which as will be appreciated can be either an inlet valve or an exhaust valve, includes a valve stem 14 and a valve head 16 which is movable between a closed position in which it engages a valve seat 18 and an open position. In a known manner, the valve stem is supported for axial movement via a valve guide 15 so as to move the valve head 16 between its open and closed positions.

In accordance with an important aspect of the present invention, to enable higher valve actuation speeds, the poppet valve system 10 of the present invention does not include a valve spring. With conventional poppet valve systems, the force necessary to maintain the valve train components in contact dictates the spring stiffness required. Therefore, with such conventional systems, the valve forces double in situations where the momentum of the valve train and the spring forces act together. The valve forces approach zero when the force from the momentum of the valve train and the spring offset each other. With the present invention, the elimination of the valve spring substantially reduces the force required to open the poppet valve 12 thereby allowing the components of the valve train to be designed to withstand higher operational speeds without any offset needed to account for stiffer valve springs. Thus, the poppet valve system 10 of the present invention can be lighter than conventional spring-based poppet valve systems.

To achieve springless operation, the poppet valve system 10 includes pivotable open and close rocker arms 20, 22 which are actuated via corresponding open and close cams or lobes 24, 26 mounted on a cam shaft 28. As will be appreciated, the open and close cams alternatively could be mounted on separate cam shafts. As shown in FIG. 1, the open and close rocker arms 20, 22 each have a respective inboard end (i.e., end closest the cam shaft 28) on which a respective cam follower, in this case in the form of a rocker roller 30, 32, is rotatably supported. The roller 32 of the close rocker arm 22 engages the surface of the close cam 26 and the roller 30 of the open rocker arm 20 engages the surface of the open cam 24. In an alternate embodiment of the invention, the rocker rollers can be eliminated. The opposing outboard end 34 (i.e. end closest the poppet valve 12) of the open rocker arm 20 engages the upper surface 38 of a valve retainer 40 arranged on the valve stem 14. In turn, the opposing outboard end 36 of the close rocker arm 22 engages the lower surface 42 of the valve retainer 40.

Figure 3:
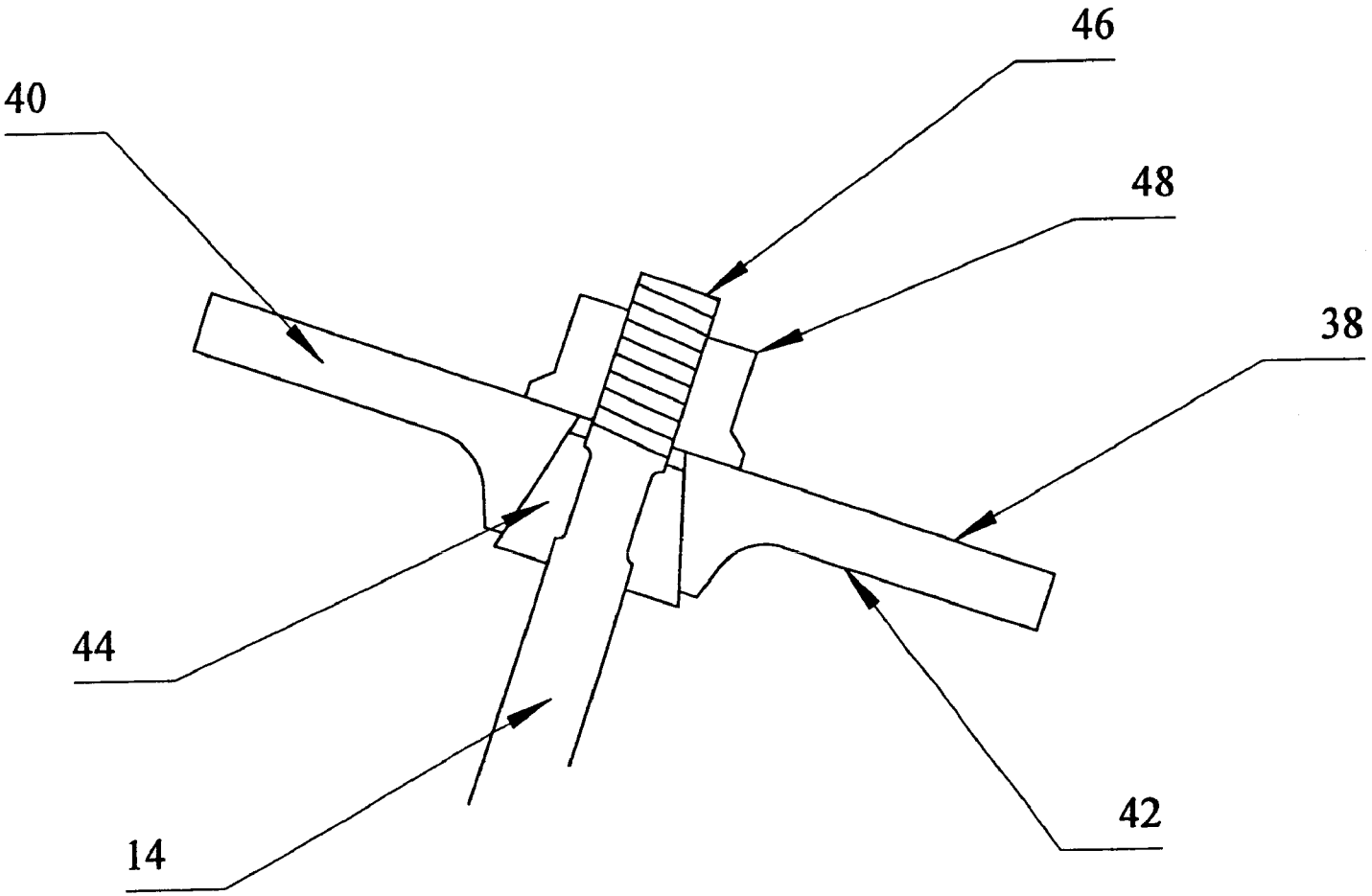
FIG. 3 is an enlarged side elevation view of the valve retainer of the poppet valve system of FIG. 1.

In the illustrated embodiment, the valve retainer 40 is configured as a radially extending flange which is arranged adjacent the upper end of the valve stem 14. As shown in FIG. 3, the retainer 40 is mounted on the valve stem 14 using standard keepers 44 arranged in an inverted position. The valve stem 14 has a threaded upper end 46 for receiving a lock nut 48 for holding the retainer 40 firmly in place on the valve stem. In addition, the valve retainer 40 has wear surfaces on its upper and lower faces 38, 42.

The open and close cams 24, 26 are configured such that upon rotation of the cam shaft 28 the rocker arms 20, 22 pivot so as to effectuate movement of the valve head 16 between the open (FIG. 1) and closed (FIG. 2) positions in accordance with the four strokes of the internal combustion engine (i.e., intake, compression, combustion, exhaust). In this case, the open and close cams 24, 26 are configured and oriented relative to each other on the cam shaft 28 such that the high lift portion 50 of the open cam 24 is arranged offset 180° from the low lift portion 52 of the close cam 26. In other words, the cams 24, 26 are configured and oriented such that they are geometrically opposite with the base circle (i.e. the profile that results in no valve motion) of the open cam 24 being the smallest radius and the base circle on the close lobe being the largest radius.

In operation, to open the poppet valve 12 (i.e. during the intake stroke if the valve is an inlet valve or during the exhaust stroke if the valve is an exhaust valve) the open and close cams 24, 26 rotate to positions wherein the high lift portion 50 of the open cam 24 and the low lift portion 52 of the close cam 26 respectively engage the roller 30 of the open rocker arm 20 and the roller 32 of the close rocker arm 22 as shown in FIG. 1. This induces the open rocker arm 20 to pivot clockwise with respect to FIG. 1 and to apply a downward force on the upper surface 38 of the valve retainer 40 which tends to move the valve head 16 out of engagement with the valve seat 18. Simultaneously, the close rocker arm 22 is rendered pivotable in the same clockwise direction of the open rocker arm 20. This relaxes the force holding the valve head 16 in the closed position thereby allowing the valve head to move out of engagement with the valve seat 18 into the open position.

As the cam shaft 28 continues to rotate, the low lift portion 54 of the open cam 24 and the high lift portion 56 of the close cam 26 respectively engage the open roller 30 and the close roller 32 as shown in FIG. 2. This leads to the close rocker arm 22 pivoting in the counterclockwise direction relative to FIG. 2 and producing a force on the lower surface 42 of the valve retainer 40 which moves the valve stem and head 14, 16 upwardly. Simultaneously, the open rocker arm 20 is permitted to pivot in the counterclockwise direction. This allows the valve head 16 to move back into engagement with the valve seat 18 and into the closed position. The poppet valve 12 is in this closed position for three of the four strokes in the engine cycle.

According to a further aspect of the present invention, to take up any excess clearances or play in the system, each of the rocker arms 20, 22 is pivotably mounted on a respective hydraulic lifter 58, 60. The open and close hydraulic lifters 58, 60 are mounted, in this case, to the engine. The open hydraulic lifter 58 moves the outboard end 34 of the open rocker arm 20 into engagement with the upper surface 38 of the valve retainer 40 thereby reducing the clearance therebetween to zero. Similarly, the close hydraulic lifter 60 moves the outboard end 36 of the close rocker arm 22 into contact with the lower surface 42 of the valve retainer 40 such that the clearance therebetween is reduced to zero. To ensure smooth operation at high speeds, the open and close cam lobes should be designed to take into account any stress deflection of the components of the valve system. With the exception of the hydraulic lifters, the rocker arms are the components that will deflect the most at high speeds. While taking such deflection into account can introduce stress into the system at slower speeds, it will ensure that the valve system operates properly at higher speeds when all of the components are under the maximum amount of stress.

The open and close hydraulic lifters 58, 60 maintain the clearance at zero because during the time they are not in use they are being pumped with hydraulic fluid to compensate for hydraulic fluid lost in the previous cycle. In this case, the open hydraulic lifter 58 is free to expand for three-fourths of the duty cycle because the valve needs to be open for only one of the four engine strokes. Since the poppet valve 12 is closed for three of the four engine strokes, the close lifter 60 can only be free of stress, so as to allow lash or play in the close rocker arm, during those times the valve is kept closed by pressure produced in the combustion chamber, i.e. the compression and power strokes. Therefore, the close lifter 60 is only being effectively pumped with hydraulic fluid during one half of the cycle, the compression and power strokes. Accordingly, the close lifter 60 should have a proportionally greater capacity than the open lifter 58. In addition, the respective capacities of the open and close lifters 58, 60 should be such that the close lifter 60 overpowers the open lifter 58 thereby ensuring valve 12 closure. The hydraulic fluid system can also be configured so that the close lifter 60 receives hydraulic fluid before the open lifter 58 thereby ensuring greater pressure in the close lifter. Due to their spring and damping capabilities, the hydraulic lifters 58, 60 eliminate any lash or binding problems in the system.

From the foregoing it will be appreciated that the poppet valve system 10 of the present invention allows the valve train to have a reduced mass and permits higher operational speeds than conventional spring-based poppet valve systems. Moreover, the use of hydraulic lifters in the system eliminates the tolerance problems that characterize conventional springless poppet valve systems.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A springless poppet valve system comprising:

a poppet valve movable between an open position and a closed position, an open cam, a close cam, an open rocker arm having an open cam follower disposed to engage the open cam at an open cam engage point and being operatively connected to the poppet valve at an open valve engage point so as to move the valve from the closed position to the open position when a high lift portion of the open cam engages the open cam follower, a close rocker arm having a close cam follower disposed to engage the close cam at a close cam engage point, and being operatively connected to the poppet valve at a close valve engage point so as to move the valve from the open position to the close position when a high lift portion of the close cam engages the close cam follower, an open hydraulic lifter pivotally connected to the open rocker arm so as to define an open rocker arm fulcrum point and operable to hold the open rocker arm in operative connection with the poppet valve, and a close hydraulic lifter pivotally connected to the close rocker arm so as to define a close rocker arm fulcrum point and operable to hold the close rocker arm in operative connection with the poppet valve, wherein the open rocker arm fulcrum point is disposed between the open cam engage point and the open valve engage point and the close rocker arm fulcrum point is disposed between the close cam engage point and the close valve engage point.

2. The poppet valve system according to claim 1 wherein the open and close cams are configured and oriented relative to each other a cam shaft such that the high lift portion of the open cam is arranged opposite a low lift portion of the close cam.

3. The poppet valve system according to claim 1 wherein the open and close rocker arms are operatively connected to the poppet valve by engagement with a valve retainer arranged on a valve stem.

4. The poppet valve system according to claim 3 wherein the valve retainer has opposing first and second surfaces and said open rocker arm engages said first surface and said close rocker arm engages said second surface.

5. The poppet valve system according to claim 4 wherein the open hydraulic lifter maintains the open rocker arm in engagement with the first surface of the valve retainer and the close hydraulic lifter maintains the close rocker arm in engagement with the second surface of the valve retainer.

6. The poppet valve system according to claim 3 wherein the valve retainer is mounted on the valve stem by keepers arranged in an inverted position and secured in place by a lock nut which engages a threaded end of the valve stem.

7. The poppet valve system according to claim 1 wherein the close hydraulic lifter can produce a relatively larger force than the open hydraulic lifter.

8. The poppet valve system according to claim 1 wherein the close hydraulic lifter overpowers the open hydraulic lifter.

9. A springless poppet valve system comprising:

a poppet valve including a valve stem movable between an open position and a closed position, an open cam, a close cam, an open rocker arm having an-open cam follower disposed to engage the open cam and being operatively connected to the poppet valve so as to move the valve from the closed position to the open position when a high lift portion of the open cam engages the open cam follower, a close rocker arm having a close cam follower disposed to engage the close cam, and being operatively connected to the poppet valve so as to move the valve from the open position to the close position when a high lift portion of the close cam engages the open cam follower, an open hydraulic lifter pivotally connected to the open rocker arm and operable to hold the open rocker arm in operative connection with the poppet valve, and a close hydraulic lifter pivotally connected to the close rocker arm and operable to hold the close rocker arm in operative connection with the poppet valve wherein the open and close rocker arms are operatively connected to the poppet valve by engagement with a valve retainer arranged on the valve stem, the valve retainer being mounted on the valve stem by keepers arranged in an inverted position and secured in place by a lock nut which engages a threaded end of the valve stem.

* * * * *